US005453751A

United States Patent [19]

Tsukamoto et al.

[11] Patent Number: 5,453,751

[45] Date of Patent: Sep. 26, 1995

[54] WIDE-BAND, DUAL POLARIZED PLANAR ANTENNA

[75] Inventors: Katsuya Tsukamoto; Iwakuni Ujiyama; Kaname Okuno, all of Kadoma, Japan

[73] Assignee: Matsushita Electric Works, Ltd., Osaka, Japan

[21] Appl. No.: 114,283

[22] Filed: Sep. 1, 1993

Related U.S. Application Data

[63] Continuation of Ser. No. 872,852, Apr. 14, 1992, abandoned.

[30] Foreign Application Priority Data

Apr. 24, 1991 [JP] Japan ..... 3-093836
Dec. 13, 1991 [JP] Japan ..... 3-330586

[51] Int. Cl.[6] ..... H01Q 1/38

[52] U.S. Cl. ..... 343/700 MS; 343/770; 343/756

[58] Field of Search ..... 343/700 MS, 767, 343/770, 771, 846, 848, 756; H01Q 1/38

[56] References Cited

U.S. PATENT DOCUMENTS 4,387,377 6/1983 Kandler ..... 343/756
4,475,107 10/1984 Makimoto et al. ..... 343/700 MS
4,477,815 10/1984 Brunner et al. ..... 343/756
4,599,623 7/1986 Havkin et al. ..... 343/756
4,614,947 9/1986 Rammos ..... 343/786
4,772,890 9/1988 Bowen et al. ..... 343/700 MS
4,816,835 3/1989 Abiko et al. ..... 343/700 MS
4,851,855 7/1989 Tsukamoto et al. ..... 343/700 MS
4,926,189 5/1990 Zaghloul et al. ..... 343/700 MS
4,929,959 5/1990 Sorbello et al. ..... 343/700 MS
5,005,019 4/1991 Zaghloul et al. ..... 343/700 MS

FOREIGN PATENT DOCUMENTS 0123350 10/1984 European Pat. Off. ..... 343/700 MS
4014133 5/1990 Germany .

*Primary Examiner*—Donald Hajec
*Assistant Examiner*—Hoanganh Le
*Attorney, Agent, or Firm*—Burns, Doane, Swecker & Mathis

[57] ABSTRACT

A planar antenna includes a set of first radiating plate and first power supplying plate in which openings of the former and power supplying terminals of the latter are respectively coupled electromagnetically to each other, and a further set of second radiating plate and second power supplying plate in which openings of the former and power supplying terminals of the latter are respectively coupled electromagnetically to each other. Antenna structure is thereby simplified while improving productivity and wide band wave reception, and allowing two different polarized waves to be received.

9 Claims, 5 Drawing Sheets

WIDE-BAND, DUAL POLARIZED PLANAR ANTENNA

This application is a continuation of application Ser. No. 07/872,852, filed Apr. 14, 1992, now abandoned.

BACKGROUND OF THE INVENTION

This invention relates to planar antennas and, more particularly, to a planar antenna which realizes reception at a high gain of two directional linear polarized waves in horizontal and vertical directions or two directional circular polarized waves of right turn and left turn.

The planar antennas of the kind referred to should find utility particularly when employed in receiving polarized waves from broadcasting satellites or communication satellites.

DESCRIPTION OF RELATED ART

Generally, there has been suggested that such a planar antenna as disclosed in, for example, U.S. Pat. No. 4,475,107 (corresponding German Application P 314 900.2) replace of conventional parabolic antennas. In the present instance, there has been a demand for a planar of the kind referred to that the antenna realizes a higher gain in reception and there have been a variety of attempts to reduce insertion loss. In U.S. Pat. No. 4,851,855 (corresponding German Patent 37 06 051), the present inventors, K. Tsukamoto et al, have suggested a planar antenna in which power supplying and radiating circuits and grounding conductor are mutually held separate through a space retaining means while rendering both power supplying and ratiating circuits to be electromagnetically coupled to a power supply With this arrangement, the power supplying circuit may be disposed in an internal space of the antenna so as to effectively reduce the insertion loss.

Further, in U.S. Pat. Nos. 4,929,959 and 5,005,019 to A. I. Zaghloul et al, there have been suggested further planar antennas in which the radiating circuit is formed with many ring-shaped slots having a patch element disposed in their center portions. The patch elements are electromagnetically coupled to the terminal ends in the power supplying circuit in a one-to-one correspondence so that the insertion loss can be reduced and assembling ability can be improved.

According to these U.S. Pat. Nos. 4,851,855, 4,929,959 and 5,005,019, it is possible to attain the reduction of insertion loss and improvement in the assembling ability as compared to other known planar antennas. In these U.S. patents, however, the radiating circuit comprises slots of a square, circular or other shape and patch elements centrally disposed respectively in each of the slots in the form of a floating islands. This requires a highly precise etching process and therefore a required etching pattern of the radiating plate is made much complicated. This has caused such problems as the manufacturing fluctuation becoming large thus lowering the yield of resultant products and generally elevating manufacturing costs.

Further, as shown in the foregoing U.S. Pat. No. 4,929,959, where the first power supplying plate, first radiating plate, second power supplying plate and second radiating plate are sequentially stacked on a grounding conductor plate (while electromagnetically coupling respective power supplying terminals of the power supplying plates to respective radiating elements in the radiating plates, the radiating elements in particular of the second radiating plate being of annular slots having the patch elements in the form of the centrally floating island for receiving the one directional polarized wave), there has arisen a risk that the patch elements cause one of the received waves, for example, the horizontally directioned linear polarized wave, to occur so that the other wave, for example, the vertically directioned linear polarized wave generated at the radiating elements in the first radiating plate, will pass through the annular slots forming the radiating elements of the second radiating plate. This causes patch elements in the floating-island form will be rather a hindrance to the operation so as to render intended antenna properties to be insufficient.

Further, in German Patent Application P 40 14 133.0 of an earlier invention of the present invention, the present inventors K. Tsukamoto et al have suggested a planar antenna in which a radiating plate is provided with apertures which are electromagnetically coupled to the power supplying terminals of the power supplying plate so that the function of radiating elements can be attained by the apertures only without aid of any patch element, and the apertures are respectively expanded in radial directions at peripheral edge portions corresponding to positions of inclination by 45 degrees with respect to abscissa passing through the center of the aperture, for receiving the circularly polarized waves at a high gain. According to this invention, it has been possible to render any higher precision of manufacturing to be unnecessary so as to simplify the manufacturing and improve the productivity, and to allow the circularly polarized waves to be received over a wide band so that the antenna can smoothly function in receiving the polarized waves from the broadcasting satellite.

In responding to a demand for increasing the number of channels in the broadcasting satellite, it is necessary to render the reception of two different polarized waves of left turn and right turn circular waves to be possible, and, in order to be responsive to the communication satellite, the antenna is required to be made receptible to two different polarized waves turned in horizontal and vertical directions. In this connection, U.S. Pat. No. 4,929,959 suggests still another planar antenna which is made possible to receive both of the right turn and left turn circular polarized waves with two types of the power supplying circuit plates and radiating circuit plates sequentially stacked. According to this U.S. patent, the two different types of the polarized waves can be received, but there has been provided no measure for simplifying the electromagnetic coupling between the power supplying terminals and the radiating elements in the radiating circuit plate, so that the arrangement will be rather complicated as the number of the circuit plates is increased, and there arises a problem that a fluctuation in various properties will be remarkable.

SUMMARY OF THE INVENTION

A primary object of the present invention is, therefore, to provide a planar antenna which is simplified in structure, improved in productivity, and capable of receiving electromagnetic waves over a wide band and also of receiving the two different types of the polarized waves, that is, horizontal and vertical directional linear polarized waves or right turn and left turn circular polarized waves.

According to the present invention, the above object can be realized by means of a planar antenna in which a grounding conductor plate, first power supplying plate, first radiating plate, second power supplying plate and second radiating plate are sequentially stacked mutually in independent relationship at regular intervals with an insulating layer interposed between the respective plates, a power supplying circuit pattern having power supplying terminals is provided to the respective power supplying plates while radiating elements are provided to the radiating plates, and the respective power supplying terminals and radiating elements are electromagnetically coupled to each other for receiving two different types of the polarized waves, characterized in that the radiating elements provided to the second radiating plate are openings while the radiating elements provided to the first radiating plate are openings respectively corresponding to the openings of the second radiating plate, the power supplying terminals of the first radiating plate are electromagnetically coupled to the respective openings of the first radiating plate, and the power supplying terminals of the second power supplying plate are electromagnetically coupled to the respective openings of the second radiating plate.

Other objects and advantages of the present invention shall become clear when descriptions of embodiments shown in accompanying drawings advance in the followings.

While the present invention shall now be explained in detail with reference to the respective preferred embodiments shown in the accompanying drawings, it should be appreciated that the intention is not to limit the invention only to the embodiments shown but rather to include all alterations, modifications and equivalent arrangements possible within the scope of appended claims.

DETAILED DESCRIPTION OF THE PREFERRED EMBODIMENTS

Figure 1:
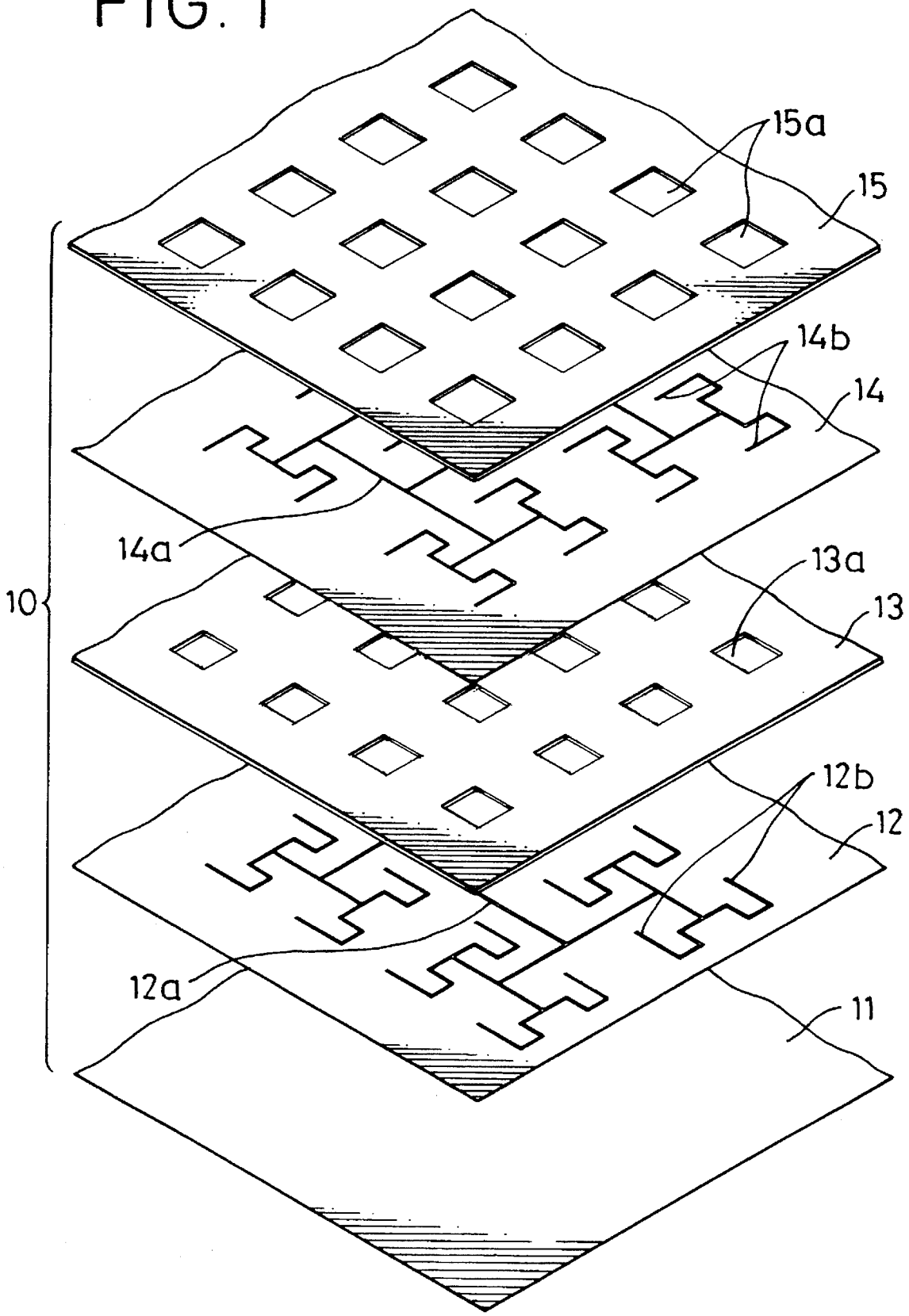
FIG. 1 shows in a perspective view as disassembled of an embodiment of the planar antenna according to the present invention.
Figure 2:
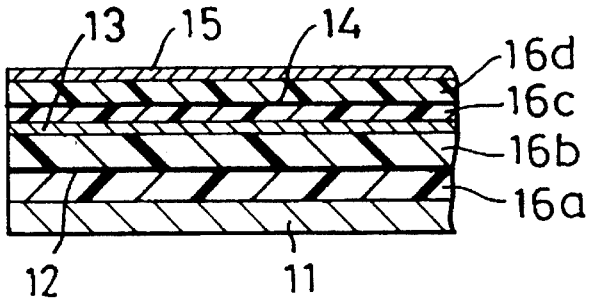
FIG. 2 is a fragmentary section as magnified of the planar antenna of FIG. 1.

Referring to FIGS. 1 and 2, there is shown a planar antenna 10 in one embodiment according to the present invention, which comprises generally a grounding conductor plate 11, first power supplying plate 12, first radiating plate 13, second power supplying plate 14 and second radiating plate 15, and these plate shaped members 11–15 are sequentially stacked to be independent of one another as spaced at regular intervals with an insulating layer interposed between them. In the present instance, for example, synthetic resin layers **16*a*–16*d* preferably of a foaming resin are interposed between the respective plate shaped members 11–15**, to function as a low-loss dielectric member.

For the grounding conductor plate 11, an aluminum plate, for example, of 2 mm thick and available on the market may be employed. Alternatively, such electrically conducting material as copper, silver, astatine, iron, gold or the like can be used as the grounding conductor plate 11. The first power supplying plate 12 is placed on the grounding conductor plate 11 as spaced therefrom at the regular interval determined by the spacer **16*a* of 2 mm thick interposed between them. This first power supplying plate 12 is formed to have a power supplying circuit pattern 12*a* including power supplying terminals 12*b*, which pattern being provided preferably by a copper foil laminated on a polyester substrate of 50 μm thick and subjected to an etching process, while the power supplying terminals 12*b* are disposed for optimumly receiving one directional polarized wave coming from the broadcasting or communication satellite. The first radiating plate 13 is disposed as spaced at the regular interval from the first power supplying plate 12 with the spacer 16*b* of 2 mm thick interposed between them. This first radiating plate 13 is formed preferably with an aluminum plate of 0.4 mm thick and subjected to punching work to provide with elongated rectangular apertures 13*a* as openings respectively 15 mm at each side to be, for example, 16 lines and 16 rows. Here, the power supplying terminals 12*b* of the first power supplying plate 12 are arranged to be optimumly electromagnetically coupled, respectively, with each aperture 13*a* of the first radiating plate 13**.

The second power supplying plate 14 is disposed on the first radiating plate 13 as spaced at the regular interval by interposing between them the spacer **16*c* of 2 mm thick. This first power supplying plate 14 is formed, similarly to the foregoing first power supplying plate 12, to have a power supplying circuit pattern 14*a* including power supplying terminals 14*b*, which pattern being provided preferably by a copper foil laminated on a polyester substrate of 50 μm thick and subjected to an etching process, while the power supplying terminals 14*b* are disposed for optimumly receiving the other directional polarized wave from the broadcasting or communication satellite, as made to extend respectively in a direction intersecting at right angles the power supplying terminals 12*b* of the first power supplying plate 12 as viewed in top plan view. Finally, the second radiating plate 15 is disposed on the second power supplying plate 14 as spaced therefrom at the regular interval defined by the 2 mm thick spacer 16*d* disposed between them, while this second radiating plate 15 is formed preferably with an aluminum plate of 0.4 mm thick and subjected to punching work to provide square apertures 15*a* without the patch element as opening respectively of 15 mm long at each side and disposed at a pitch of 23 mm between center points of adjacent ones of the apertures 15*a*, to be, for example, 16 lines and 16 rows. Here, the power supplying terminals 14*b* of the second power supplying plate 14 and the apertures 15*a* of the second radiating plate 15 are disposed to be mutually optimumly electromagnetically coupled. Further, each aperture 15*a* of the second radiating plate 15 and each apertures 13*a* of the first radiating plate 13 as well as the power supplying terminals 14*b* and 12*b* of the second and first power supplying plates 14 and 12 and respectively electromagnetically coupled to the apertures 13*a* and 15*a* are arranged to be positioned within each contour of the aperture 15***a* as viewed in the top plan view as will be clear from FIG. 3, and the power supply terminals 14*b* and 12*b* extend in directions mutually intersecting at right angles within the contour.

For the substrate of the first and second power supplying plates 12 and 14, it is possible to employ, instead of the polyester substrate, a synthetic resin sheet prepared with one or a mixture of two or more of polypropylene, polyethylene, acryl, polycarbonate, ABS resin and PVC resin, and, for the power supplying circuit patterns 12*a* and 14*a*, it is also possible to form them, instead of the copper foil, with such other conducting material as aluminum, silver, astatine, iron or gold. Further, while the spacers 16*a*–16*d* have been referred to as being interposed between the respective plate members 11–15, it may be also possible to have only air space made to be present to act as the insulating layer between the respective plate members 11–15 with any other space retaining means.

Figure 3:
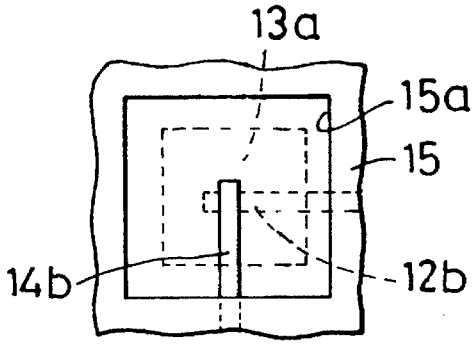
FIG. 3 is a fragmentary plan view as magnified of the planar antenna of FIG. 1.

An experimental reception of the polarized waves from the communication satellite has been carried out with the planar antenna 10 in such an arrangement as shown in FIGS. 1–3, and it has been found that the two different linearly polarized waves in horizontal and vertical directions could be received at a high gain. More practically, measurement has been made with respect to VSWR, gain and cross polarized wave characteristics, and it has been possible to obtain a high efficiency of more than 64% for such a wide band of 11.2 to 12.2 GHz, that is, for a range of 1 GHz, and such high cross polarized wave characteristics as more than 25 db. Here, in contrast to the case of such annular slot as in the foregoing U.S. Pat. No. 4,929,959 in which the radiating elements in the second radiating plate comprise the slots and floating-island form patch elements centrally disposed in the slots, the apertures in the second radiating plate are effectively magnetically coupled to, for example, the vertically directed linear polarized wave generated at the radiating elements in the first radiating plate, so as not to be any hindrance. Since in this case the horizontally directed linear polarized wave is to be generated by the electromagnetic coupling between the apertures in the second radiating plate and the power supplying terminals of the second power supplying plate, it will be appreciated that the apertures as the radiating elements of the second radiating plate are contributive to the generation of both of the horizontally and vertically directed linear polarized waves so as to be able generally to the improvement in the efficiency of the planar antenna.

Figure 5:
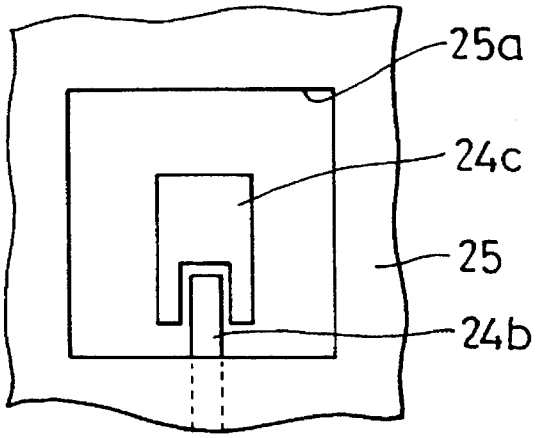
FIG. 5 is a fragmentary plan view as magnified of the planar antenna of FIG. 4.
Figure 4:
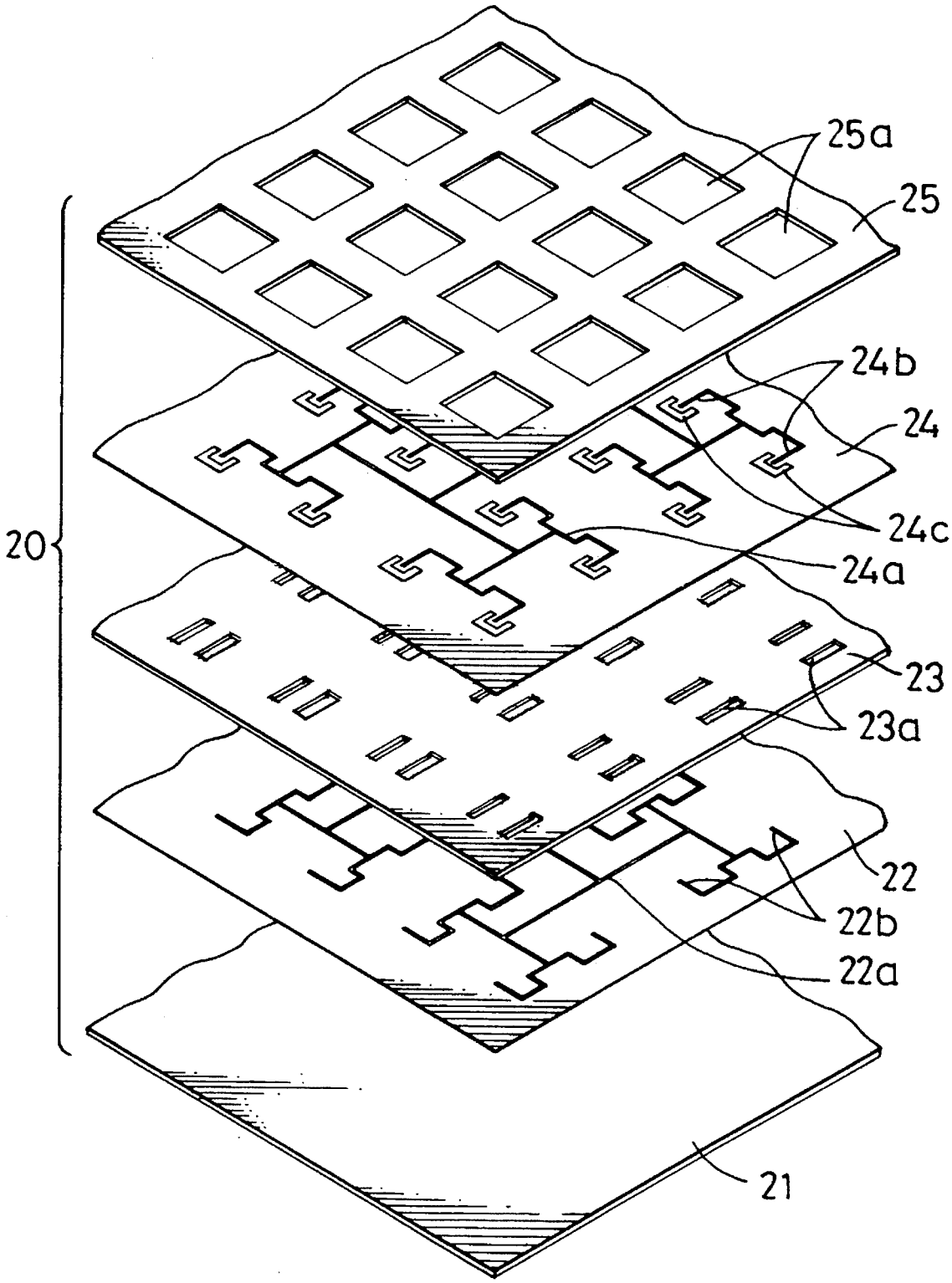
FIG. 4 shows in a perspective view as disassembled another embodiment according to the present invention.

Referring next to FIG. 4, there is shown another embodiment of the planar antenna according to the present invention, in which the square apertures 25*a* as the opening formed in the second radiating plate 25 are provided to be more densely than the foregoing embodiment of FIG. 1, preferably as disposed at a pitch of 20 mm between the centers of the adjacent ones of the respective apertures 25*a*. Further, as will be clear when FIG. 5 is also referred to in conjunction with FIG. 4, the second power supplying plate 24 is formed to be additionally provided in its power supplying circuit pattern 24*a* with conductor lands 24*c*, each of which opposing to terminating edge of each of the power supplying terminals 24*b* and so extending as to hold the terminal along both its sides. The conductor lands 24*c* are respectively formed to be substantially in a U-shape having preferably a length of 9 mm along the longer side in which direction the land including a notch in which the power supplying terminal 24*b* is extended, and a width of 5 mm along the shorter side, so that the electromagnetic coupling force between the square apertures 25*a* of the second radiating plate 25 and the power supplying terminals 24*b* of the second power supplying plate 24 will be strengthened. In the present embodiment, further, the first radiating plate 23 is provided with elongated rectangular slots 23*a* as the openings of 15 mm long and 3 mm wide, which are respectively in pairs and corresponding to each aperture 25*a* of the second radiating plate 25.

Figure 6:
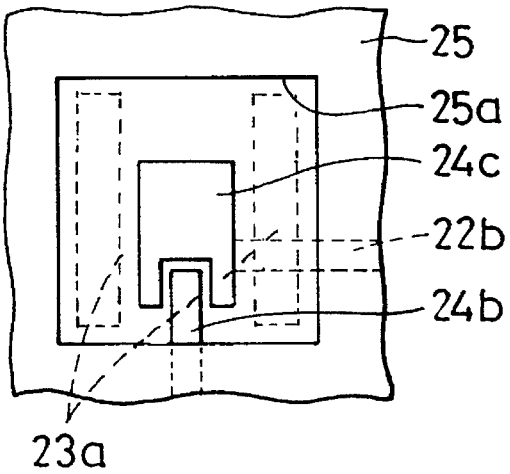
FIG. 6 is an explanatory view for the arrangement of the planar antenna of FIG. 4.

Each of the square apertures 25*a* and each pair of rectangular slots 23*a* as well as each of the power supplying terminals 22*b* and 24*b* of the first and second power supplying plates 22 and 24 are so arranged, in the top plan view as shown in FIG. 6, that the pair of the slots 23*a* are disposed within the contour of the square aperture 25*a*, the terminal 24*b* and additional land 24*c* are disposed between the pair of the slots 23*a* and the terminal 22*b* extends to be at right angles with respect to the pair of the slots 23*a* and the terminal and land 24*b* and 24*c*.

In the embodiment of FIGS. 4–6, further, other arrangements and their functions are the same as those in the foregoing embodiment of FIGS. 1–3, and substantially the same constituent elements as those in FIGS. 1–3 are shown in FIGS. 4–6 with the same reference numerals but as added by 10.

The polarized waves from the communication satellite have been received by the planar antenna 20 of the arrangement shown in FIGS. 4–6, and it has been found that the two different linearly polarized waves in horizontal and vertical directions could have been received at a higher gain. More practically, measurement of their VSWR, gain and cross polarized wave characteristics has shown that a high efficient of more than 64% over a wide band of 11.2–12.2 GHz (1 GHz) and high cross polarized wave characteristics of more than 25 dB could be obtained.

Figure 7:
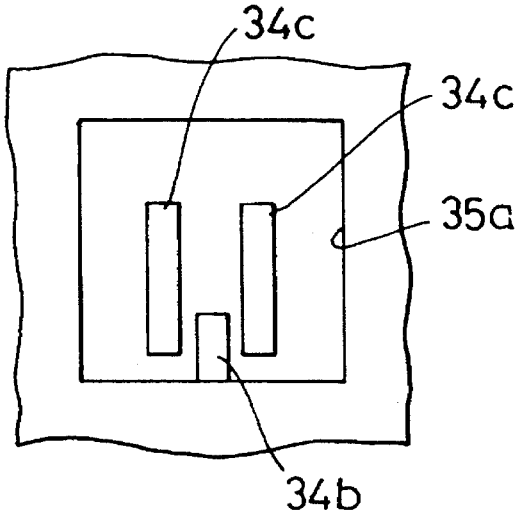
FIGS. 7 and 8 are fragmentary plan views as magnified of different working aspects.
Figure 8:
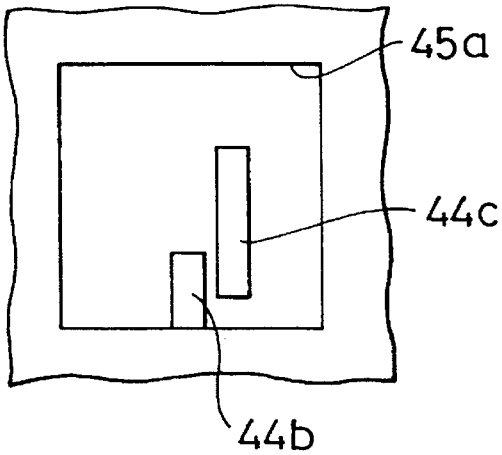

Further, while in the embodiment of FIGS. 4–6 the conductor land 24*c* has been disclosed to be formed on the same surface as that of the power supplying terminal 24*b* of the second power supplying plate 24, the conductor land 24*c* provided on the other surface of the second power supplying plate 24 than that having the power supplying terminals 24*b* can be commonly contributive to the strengthening of the electromagnetic coupling between the apertures 25*a* of the second radiating plate 25 and the second power supplying terminals 24*b* of the second power supplying plate 24. Further, while the conductor land 24*c* in embodiment of FIGS. 4–6 has been shown to be formed in the U-shaped to enclose the power supplying terminal 24*b*, it is also possible to provide the conductor land in two divided lands 34*c* of a rectangular shape as shown in FIG. 7, which are extending mutually in parallel and to the power supplying terminal 34*b* and edge of which is disposed between the divided lands 34*c*, and also to be disposed within the contour of the aperture 35*a* in the top plan view. In this case, the divided lands 34*c* are made preferably to be 9 mm in the length and 2 mm in the width, and are separated by 0.5 mm from both side edges of the power supplying terminal 34*b*. Further, as shown in FIG. 8, it is also possible to provide a single rectangular conductor land 44*c* disposed close to one side edge of the power supply terminal 44*b* and within the contour of the square aperture 45*a* in the plan view, in which event, too, it is preferable to form the single conductor land 44*c* to be 9 mm long and 2 mm wide and as spaced by 0.5 mm from one side edge of the terminal 44*b*. In either one of these two aspects of FIGS. 7 and 8, it has been found that same characteristics as those in the foregoing embodiment of FIGS. 4–6 can be obtained.

Figure 9:
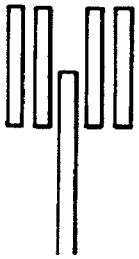
FIGS. 9 to 14 are schematic fragmentary plan views showing respectively further working aspects.
Figure 10:
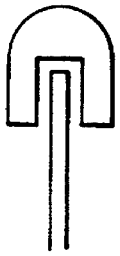
Figure 11:
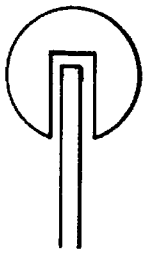
Figure 12:
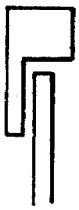
Figure 13:
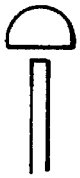
Figure 14:
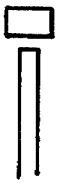

In addition, the configuration of the conductor land with respect to the power supplying terminal may properly be of any one of such various types as shown in FIGS. 9–14, in which FIG. 9 is of two pairs of rectangular lands with each pair disposed on each side of the power supplying terminal, FIG. 10 is of a another U-shaped land further elongated than that of FIG. 5, FIG. 11 is of still another U-shaped land substantially rounded, FIG. 12 is of an L-shaped land a longer leg portion of which extending along the terminal, FIG. 13 is of a semicircular shaped land, and FIG. 14 is of a small square shaped land.

Figure 15:
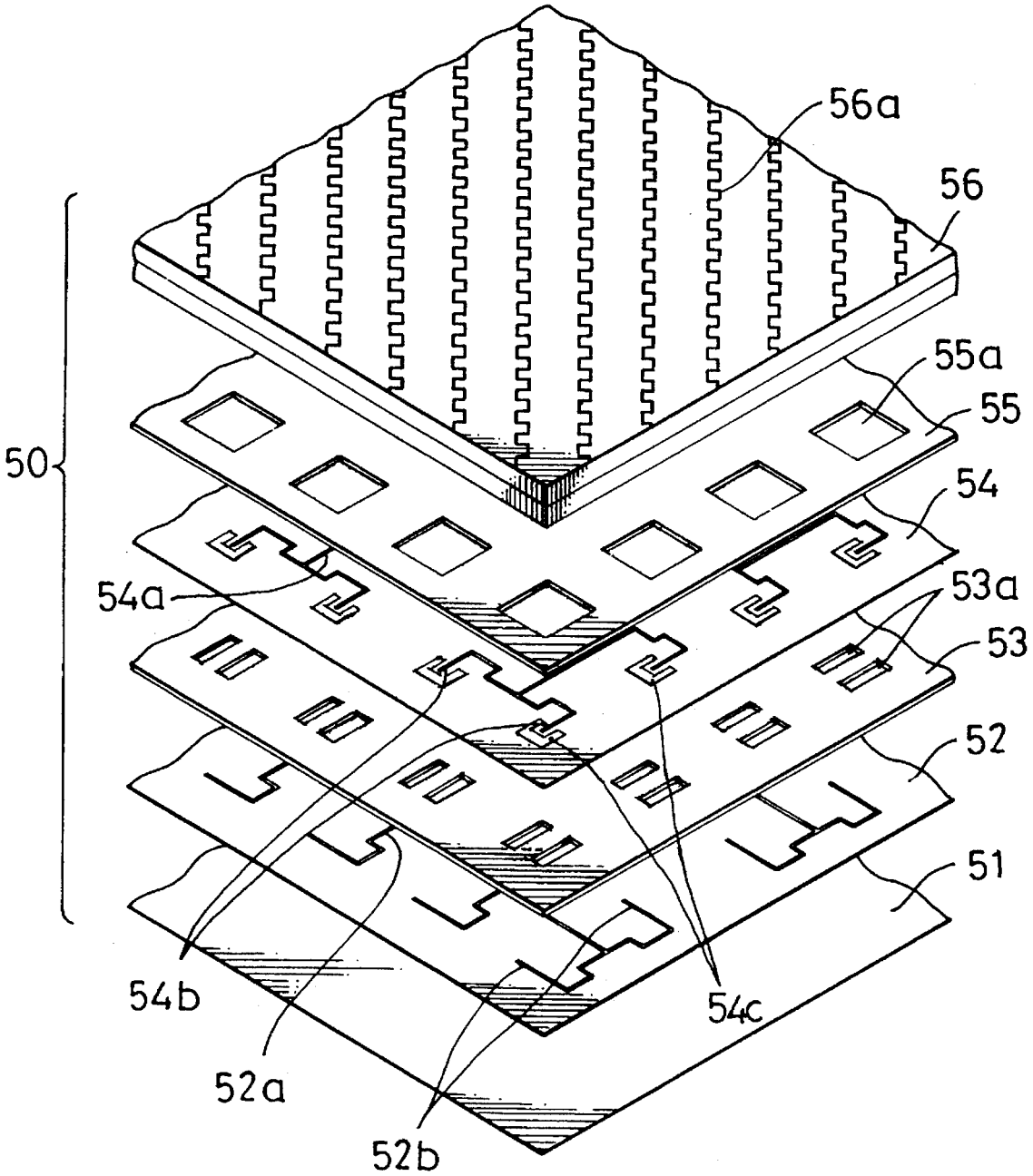
FIG. 15 shows in a perspective view as disassembled a further embodiment according to the present invention.

Referring now to FIG. 15, there is shown a further embodiment of the planar antenna according to the present invention, in which a polarizer 56 is provided on the second radiating plate 55, and this polarizer 56 comprises three flexible printed circuit boards respectively having a conductor pattern 56*a* of meandering line conductors or mesh formation conductors and stacked to be positioned top, middle and bottom layers, with two foamed plastic boards, for example, interposed between them. With this planar antenna 50 of the present instance provided with the polarizer 56, the two different linearly polarized waves in horizontal and vertical directions and incident upon the planar antenna 50 through the polarizer 56 have been converted into two different circularly polarized waves in left and right turns which were highly efficiently received. Measurement of VSWR, gain and cross poralized wave characteristics has shown that a high efficiency of more than 64% and high cross polarized characteristics of more than 25 dB over such wide band of 11.5–12.2 GHz (0.7 GHz) could be obtained.

While in the above polarizer 56 the foamed plastic boards have been disclosed to be interposed between the flexible printed circuit boards, it is possible to replace them with, for example, foamed plastic sheets or lattice-shaped foamed plastic sheets providing many spaces therein. Further, the conductor pattern 56*a* may be the one directly printed on one surface or on both surfaces of a foamed plastic sheet. Further, the arrangement of the embodiment shown in FIGS. 4–6 or any one of such various aspects as shown in FIGS. 7–14 may properly be employed in the present embodiment, and it is optimum that in particular the conductor lands 54*c* are provided with respect to the power supply terminals 54*b* of the second power supply plate 54 in the same manner as in the foregoing embodiment.

In the embodiment of FIG. 15, all other arrangements and their function are the same as those in the embodiment of FIGS. 1–3, and substantially the same constituents as those in FIGS. 1–3 are denoted in FIG. 15 by the same reference numerals as those used in FIGS. 1–3 but as added by 40.

Figure 16:
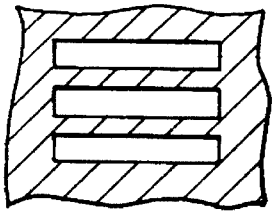
FIGS. 16 to 19 are fragmentary schematic views for explaining still further aspects of slots in the present invention.
Figure 17:
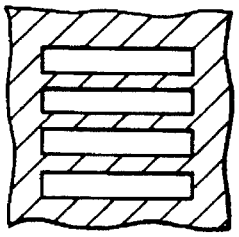
Figure 18:
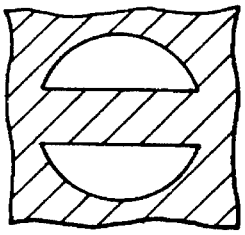
Figure 19:
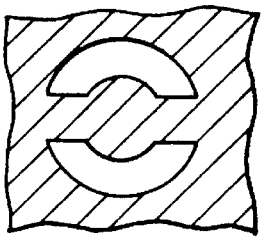
Figure 20:
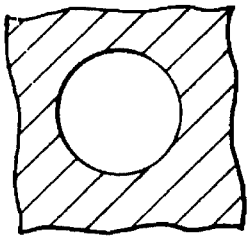
FIG. 20 is a fragmentary schematic view for explaining a further aspect of the aperture in the present invention.

In addition, for the configuration of the slots as the openings provided in the first radiating plate in the respective embodiments of FIGS. 4 and 15, it is possible to replace them with any one of such various types of the slots as shown in FIGS. 16–19, in which FIG. 16 is of a set of three parallel rectangular slots, FIG. 17 is of a set of four parallel rectangular slots, FIG. 18 is of a pair of arcuate slots and FIG. 19 is of a pair of semiannular slots. Further, the apertures of the second radiating plate may not be limited to be of the square shape but may be of such circular aperture as shown in FIG. 20.

Further, as above explained, said opening, preferably said aperture of the second radiating plate only indicates a space without the patch element.

What is claimed:

1. A planar antenna consisting essentially of:

a grounding conductor plate, a first power supplying plate disposed to be independent of said grounding conductor plate as spaced therefrom at a regular interval with an insulating layer interposed and provided with a power supplying conductor pattern including power supplying terminals, a first radiating plate formed with a metallic plate disposed to be independent of said first power supplying plate as spaced therefrom at the regular interval with an insulating layer interposed and provided with openings acting as radiating elements electromagnetically coupled to said power supplying terminals of the first power supplying plate, said openings of said first radiating plate being made as fully open apertures in said metallic plate forming the first radiating plate, a second power supplying plate disposed to be independent of said first radiating plate as spaced therefrom at the regular interval with an insulating layer interposed and provided with a power supplying conductor pattern including power supplying terminals, and a second radiating plate formed with a metallic plate disposed to be independent of said second power supplying plate as spaced therefrom at the regular interval with an insulating layer interposed and provided with openings formed to oppose said fully open apertures of said first radiating plate and acting as radiating elements electromagnetically coupled to said power supplying terminals of said second power supplying plate, said openings of said second radiating plate being made as fully open apertures without any metallic material within a zone of electromagnetic coupling of each opening to each power supplying terminal of said second power supplying plate in said metallic plate forming said second radiating plate with no other metallic plates above said second radiation plate wherein said metallic plate of said second radiating plate has a thickness smaller than that of said insulating layer interposed between said second power supply plate and said second radiating plate.

2. The planar antenna of claim 1 wherein said fully open apertures of said first radiating plate are pairs of slots.

3. The planar antenna of claim 2 wherein said fully oven apertures of the second radiating plate are square shape.

4. The planar antenna of claim 2 wherein said fully open apertures of the second radiating plate are circular in shape.

5. The planar antenna of claim 2 wherein said power supplying terminals of said second power supplying plate are respectively provided with a conductor land disposed adjacent each terminal as separated therefrom.

6. The planar antenna of claim 5 wherein said power supplying terminals of said second power supplying plate, said conductor lands, said apertures of said first radiating plate and said power supplying terminals of said first power supplying plate are so arranged as to be commonly disposed, in top plan view, within a contour of respective said apertures of said second radiating plate.

7. The planar antenna of claim 6 which further comprises a polarizer disposed on the top surface of said second radiating plate, said polarizer being provided for converting linearly polarized waves into circularly polarized waves, and said polarizer comprising a stack of three printed circuit boards respectively having a conductor pattern for said conversion of polarized waves, with a plastic board interposed between respective said circuit boards.

8. The planar antenna of claim 1 wherein said power supplying terminals of said second power supplying plate are respectively provided with a conductor land disposed adjacent each terminal as separated therefrom.

9. The planar antenna of claim 1 which further comprises a polarizer disposed on the top surface of said second radiating plate, said polarizer being provided for converting linearly polarized waves into circularly polarized waves, and said polarizer comprising a stack of three printed circuit boards respectively having a conductor pattern for said conversion of polarized waves, with a plastic board interposed between respective said circuit boards.

* * * * *